US008444379B2

(12) United States Patent
Nakaniwa et al.

(10) Patent No.: US 8,444,379 B2
(45) **Date of Patent: *May 21, 2013**

(54) SEALING DEVICE FOR ROTARY FLUID MACHINE, AND ROTARY FLUID MACHINE

(75) Inventors: Akihiro Nakaniwa, Takasago (JP); Yuji Futagami, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 715 days.

This patent is subject to a terminal disclaimer.

(21) Appl. No.: 12/528,191

(22) PCT Filed: May 29, 2008

(86) PCT No.: PCT/JP2008/059911

§ 371 (c)(1),
(2), (4) Date: Aug. 21, 2009

(87) PCT Pub. No.: WO2008/149773

PCT Pub. Date: Dec. 11, 2008

(65) Prior Publication Data

US 2010/0119367 A1 May 13, 2010

(30) Foreign Application Priority Data

Jun. 6, 2007 (JP) ..... 2007-150678

(51) Int. Cl.
*F04D 1/06* (2006.01)

(52) U.S. Cl.
USPC ..... 415/208.1; 415/230

(58) Field of Classification Search
USPC ..... 415/111–113, 144, 145, 170.1, 171.1, 415/172.1, 173.5, 173.6, 174.5, 185, 191, 415/192, 229, 230; 277/413, 415–421
See application file for complete search history.

(56) References Cited

U.S. PATENT DOCUMENTS 2,618,433 A * 11/1952 Loos et al. ..... 415/115
4,248,566 A * 2/1981 Chapman et al. ..... 415/26

(Continued)

FOREIGN PATENT DOCUMENTS

JP 58-22444 7/1981
JP 56-107997 8/1981

(Continued)

OTHER PUBLICATIONS

International Search Report issued Aug. 26, 2008 in International Application No. PCT/JP2008/059911.

(Continued)

*Primary Examiner* — Edward Look
*Assistant Examiner* — Christopher R Legendre
(74) *Attorney, Agent, or Firm* — Wenderoth, Lind & Ponack, L.L.P.

(57) ABSTRACT

A sealing device includes a housing rotatably accommodating a rotary shaft, guide parts extending along a radial direction and an axial direction of the rotary shaft, and arranged side-by-side in a circumferential direction of the rotary shaft, a partition part that is a partition between spaces between the guide parts and an outside space, a first seal part that is an annular protrusion, forming a first gap with respect to the rotary shaft or the partition part, and blocking a flow of fluid passing through the outside space, and a second seal part that is an annular protrusion extending in the radial direction, forming a second gap with respect to the rotary shaft or the housing, and blocking a flow of fluid that has passed through the spaces between guide parts and a flow of fluid that has passed through the first seal part.

8 Claims, 8 Drawing Sheets

U.S. PATENT DOCUMENTS

| | | | | |
|---|---|---|---|---|
| 4,415,310 | A * | 11/1983 | Bouiller et al. | 416/95 |
| 4,938,661 | A * | 7/1990 | Kobayashi et al. | 415/199.1 |
| 5,161,943 | A * | 11/1992 | Maier et al. | 415/170.1 |
| 5,236,301 | A * | 8/1993 | Palmer | 415/116 |
| 5,277,541 | A * | 1/1994 | Palmer | 415/58.2 |
| 6,435,822 | B1 * | 8/2002 | Kobayashi et al. | 415/172.1 |
| 6,959,929 | B2 * | 11/2005 | Pugnet et al. | 277/408 |
| 8,328,510 | B2 * | 12/2012 | Nakaniwa et al. | 415/208.1 |
| 2010/0028148 | A1 * | 2/2010 | Nakaniwa et al. | 415/230 |
| 2010/0119367 | A1 * | 5/2010 | Nakaniwa | 415/230 |

FOREIGN PATENT DOCUMENTS

| | | |
|---|---|---|
| JP | 59-226299 | 12/1984 |
| JP | 2756118 | 7/1989 |
| JP | 5-296190 | 11/1993 |
| JP | 2002-22033 | 1/2002 |

OTHER PUBLICATIONS

Notice of Allowance issued Aug. 15, 2012 in corresponding U.S. Appl. No. 12/528,509.

* cited by examiner

SEALING DEVICE FOR ROTARY FLUID MACHINE, AND ROTARY FLUID MACHINE

BACKGROUND OF THE INVENTION

I. Technical Field

The present invention relates to sealing devices for rotary fluid machines and to rotary fluid machines.

II. Description of the Related Art

In general, rotary machines that compress or expand fluid, such as centrifugal compressors or expanders, use a seal such as a labyrinth seal in order to prevent a fluid leak from a high-pressure portion to a low-pressure portion.

The labyrinth seal is disposed between a fixed part such as a housing and a rotating part such as a rotary shaft, and a seal gap is provided between the labyrinth seal and the rotating part or between the labyrinth seal and the fixed part, in order to ensure the rotation of the rotating part.

A small amount of fluid leaking from the high-pressure portion to the low-pressure portion flows through the seal gap, and the leakage flow includes velocity components in the circumferential direction of the rotary shaft under the influence of the rotation of the rotary shaft. Hereinafter, the leakage flow that includes velocity components in the circumferential direction is referred to as swirling flow.

If a swirling flow exists in the seal gap, it is known that an exciting force that disturbs the behavior of the rotary shaft, that is, a destabilizing force, may occur. It is known that the destabilizing force increases when the difference in pressure between the high-pressure portion and the low-pressure portion in the rotary machine increases.

In order to solve such a problem, technologies of providing guide grooves or guide blades for canceling or eliminating the velocity components in the circumferential direction of the rotary shaft included in the swirling flow have been proposed (for example, see Japanese Unexamined Patent Application, Publication No. S58-022444 and Publication of Japanese Patent No. 2756118).

SUMMARY OF THE INVENTION

However, there is a problem in that even when guide grooves or guide blades described in Japanese Unexamined Patent Application, Publication No. S58-022444 and Publication of Japanese Patent No. 2756118 are provided, the swirling flow does not pass through these guide grooves or guide blades, and thus the velocity components in the circumferential direction are not sufficiently cancelled or eliminated.

Specifically, since a gap is formed between the above-mentioned guide grooves or the like and the fixed part, or between the above-mentioned guide grooves or the like and the rotating part, in order to ensure the rotation of the rotating part, the swirling flow tends to flow not through the guide grooves or the like, having a higher passage resistance, but through the gap, having a lower passage resistance. Therefore, a problem arises in that velocity components in the circumferential direction are not sufficiently canceled or eliminated by the guide grooves or the like.

The present invention has been made to solve the above-described problem, and an object thereof is to provide a sealing device for a rotary fluid machine and a rotary fluid machine capable of stabilizing the behavior of the rotary shaft in the rotary fluid machine.

In order to achieve the above-described object, the present invention provides the following solutions.

According to a first aspect, the present invention provides a sealing device for a rotary fluid machine, including: a housing that rotatably accommodates a rotary shaft; a plurality of guide parts that are mounted on an inner surface of the housing, that extend along at least one of a radial direction and an axial direction of the rotary shaft, and that are arranged side-by-side in a circumferential direction of the rotary shaft; a partition part that connects other ends of the plurality of guide parts opposite to ends thereof mounted on the housing and that serves as a partition between spaces between the plurality of guide parts and an outside space; a first seal part that is an annular protrusion, that forms a first gap with respect to the rotary shaft or the partition part, and that blocks a flow of fluid passing through the outside space; and a second seal part that is an annular protrusion extending in the radial direction, that forms a second gap with respect to the rotary shaft or the housing, and that blocks a flow of fluid that has passed through the spaces between the plurality of guide parts and a flow of fluid that has passed through the first seal part.

According to a first aspect of the present invention, most of the fluid flowing from the plurality of guide parts toward the second seal part flows between the plurality of guide parts surrounded by the plurality of guide parts, the housing, and the partition part, and the rest of the fluid flows through the first gap formed by the first seal part. Since the plurality of guide parts extend along at least one of the radial direction and the axial direction of the rotary shaft, flow velocity components in the radial direction included in the fluid flowing between the plurality of guide parts are cancelled or eliminated while the fluid flows between the plurality of guide parts. Therefore, it is possible to stabilize the behavior of the rotary shaft in the rotary fluid machine.

In the first aspect of the invention, it is preferable to have a structure in which: the other ends of the plurality of guide parts face an impeller extending from the rotary shaft outward in the radial direction; and the partition part extends in the radial direction, is formed in a ring-plate-like shape to connect the other ends, and makes the fluid pass inward in the radial direction through the spaces between the plurality of guide parts.

By doing so, when the fluid flowing through the spaces between the plurality of guide parts is directed inward along the radial direction, the length of the sealing device along the axial direction can be reduced.

Further, it is possible to increase the lengths of the guide parts in the direction along the flow of the fluid, in other words, the lengths thereof in the radial direction, without changing the length of the sealing device along the axial direction. Therefore, the flow velocity components in the radial direction included in the fluid can be cancelled or eliminated more reliably while the fluid flows between the plurality of guide parts.

In the first aspect of the invention, it is preferable that the other ends of the plurality of guide parts face an outer circumferential surface of the rotary shaft; and the partition part extend in the axial direction, be formed in a cylindrical shape to connect the other ends, and make the fluid pass along the axial direction through the spaces between the plurality of guide parts.

By doing so, when fluid flowing through the spaces between the plurality of guide parts is directed toward the second seal part along the axial direction, the length of the sealing device along the radial direction can be reduced.

In the above-described structure, it is preferable that the first seal part be an annular protrusion extending in the radial direction; and a step part that radially extends the outer circumferential surface of the rotary shaft be provided at a location of the rotary shaft facing the first seal part or the second seal part.

By doing so, when the step part, which radially expands the outer circumferential surface of the rotary shaft, is provided at a location facing the first seal part or the second seal part, the relative position of the first gap and the second gap in the radial direction can be changed. Therefore, the fluid that has passed through the first gap is prevented from directly flowing into the second gap, and the sealing performance of the sealing device can be improved.

In the first aspect of the invention, it is preferable that the guide parts be plate-like members extending along the radial direction or the axial direction.

By doing so, when the guide parts are formed in a plate-like shape, which is simpler than the shape of blade-like guide parts, for example, the sealing device is easily manufactured.

In the first aspect of the invention, it is preferable that the guide parts be blade-like members extending along the radial direction or the axial direction and be curved against a rotation direction of the rotary shaft.

By doing so, when the guide parts are formed in a blade-like shape and are curved against the rotation direction of the rotary shaft, it is possible to reduce loss that occurs when the flow velocity components in the circumferential direction included in the fluid flow are cancelled or eliminated, compared with plate-like guide parts.

According to a second aspect, the present invention provides a rotary fluid machine including the sealing device according to the first aspect of the present invention.

According to the second aspect of the present invention, since the sealing device according to the first aspect of the present invention is provided, it is possible to cancel or eliminate flow velocity components in the circumferential direction included in the fluid flow flowing between the sealing device and the rotary shaft and to stabilize the behavior of the rotary shaft in the rotary fluid machine.

According to the sealing device for a rotary fluid machine of the first aspect of the present invention and the rotary fluid machine of the second aspect thereof, the first seal part is provided to cause most of the fluid flow flowing from the plurality of guide parts toward the second seal part to flow between the plurality of guide parts surrounded by the plurality of guide parts, the housing, and the partition part, thereby canceling or eliminating flow velocity components in the radial direction included in the fluid flowing between the plurality of guide parts while the fluid flows between the plurality of guide parts. Therefore, an advantage is afforded in that the behavior of the rotary shaft can be stabilized in the rotary fluid machine.

DETAILED DESCRIPTION OF THE INVENTION

First Embodiment

A compressor according to a first embodiment of the present invention will be described below with reference to FIGS. 1 to 4.

Figure 1:
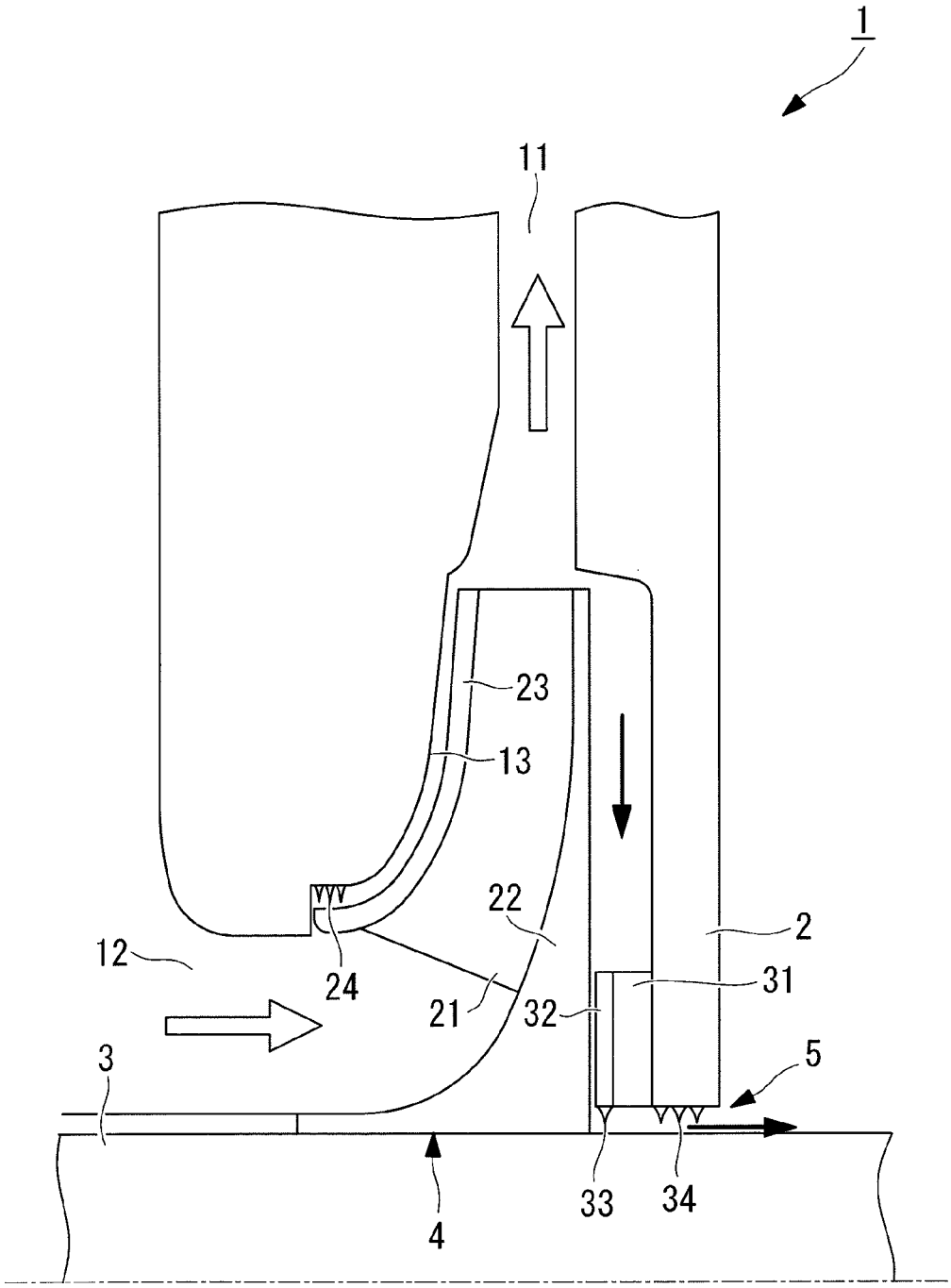
FIG. 1 is a schematic view explaining the structure of a compressor according to a first embodiment of the present invention.

FIG. 1 is a schematic view for explaining the structure of the compressor according to this embodiment.

A compressor (rotary fluid machine) 1 is supplied with a rotary driving force from an external power source, such as a motor, to supply high-pressure gas. In this embodiment, a description will be given of a single-stage compressor of the present invention.

As shown in FIG. 1, the compressor 1 includes a housing 2, a rotary shaft 3, an impeller 4, and a sealing device 5.

The housing 2 rotatably holds the rotary shaft 3 and the impeller 4 therein and includes the sealing device 5 on an inner surface thereof. Further, the housing 2 includes a high-pressure-side flow passage 11 that supplies high-pressure gas to the outside, a low-pressure-side flow passage 12 that supplies low-pressure gas (for example, air at atmospheric pressure) from the outside to the impeller 4, and an impeller chamber 13 in which the impeller 4 is rotatably disposed.

The high-pressure-side flow passage 11 extends from an outer side in the radial direction of the rotary shaft 3 toward the rotary shaft 3 and is formed so as to cover an outer circumferential edge of the impeller 4. The high-pressure-side flow passage 11 is connected to an external high-pressure gas pipe, for example.

The low-pressure-side flow passage 12 extends along the axial direction of the rotary shaft 3 and is formed so as to cover an end of the impeller 4.

The impeller chamber 13 is a space formed between the high-pressure-side flow passage 11 and the low-pressure-side flow passage 12 to be a substantially similar figure to the impeller 4 disposed therein. A through-hole through which the rotary shaft 3 passes is formed at a location in the impeller chamber 13 that faces a disc 22, and the sealing device 5 is disposed in the through-hole.

The rotary shaft 3 transmits externally-supplied rotary driving force to the impeller 4 when it is used in a compressor, and transmits power supplied by gas when it is used in an expander.

As shown in FIG. 1, the impeller 4, which extends outward in the radial direction, is provided at the center portion of the rotary shaft 3.

The impeller 4 is rotationally driven by the externally-supplied rotary driving force, and transmits its kinetic energy to gas to increase the pressure of the gas.

The impeller 4 includes a plurality of rotary vanes 21, the disc 22, and a shroud 23. Note that the impeller 4 need not include the shroud 23; the structure of the impeller 4 is not particularly limited.

The rotary vanes 21 are rotationally driven to give energy to low-pressure gas entering from the low-pressure-side flow passage 12 and flowing in between the rotary vanes 21, thereby generating high-pressure gas.

The rotary vanes 21 are disposed between the disc 22 and the shroud 23 at equal intervals in the circumferential direction of the rotary shaft 3 and extend in the axial direction.

The disc 22 is a disc-like member extending from the rotary shaft 3 outward in the radial direction and is formed to have a smoothly-curved surface that faces the low-pressure-side flow passage 12 and that approaches the low-pressure-side flow passage 12 toward the rotary shaft 3. On the other hand, a rear surface (surface at the right side in FIG. 1) of the disc 22 is formed to be substantially perpendicular to the rotary shaft 3, and a gap through which a disc-back flow flows is formed between the rear surface of the disc 22 and the impeller chamber 13.

The shroud 23 is a ring-plate-like member that is located close to the low-pressure-side flow passage 12 and oppositely to the disc 22 and that extends along the radial direction of the rotary shaft 3, and is formed to have a curved surface approaching the low-pressure-side flow passage 12 toward the rotary shaft 3. A shroud-side seal part 24 that blocks a leakage flow flowing between the shroud 23 and the impeller chamber 13 is provided on a surface of the impeller chamber 13 that faces the shroud 23, in an area adjacent to the low-pressure-side flow passage 12.

The shroud-side seal part 24 is annular protrusions extending from the impeller chamber 13 toward the shroud 23 to form a labyrinth seal.

The sealing device 5 blocks a gas flow leaking from between the housing 2 and the rotary shaft 3 to the outside (atmosphere) and cancels or eliminates flow velocity components in the circumferential direction of the rotary shaft 3, included in the leakage flow.

The sealing device 5 includes a plurality of guide plates (guide parts) 31, a partition plate (partition part) 32, a first seal part 33, and a second seal part 34.

Figure 2:
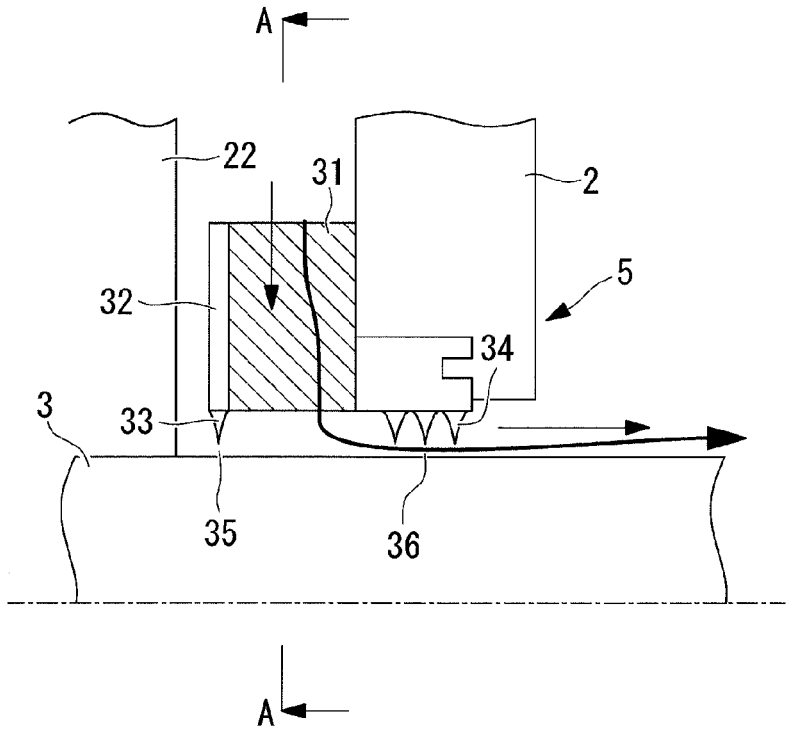
FIG. 2 is a schematic view explaining the structure of a sealing device shown in FIG. 1.
Figure 3:
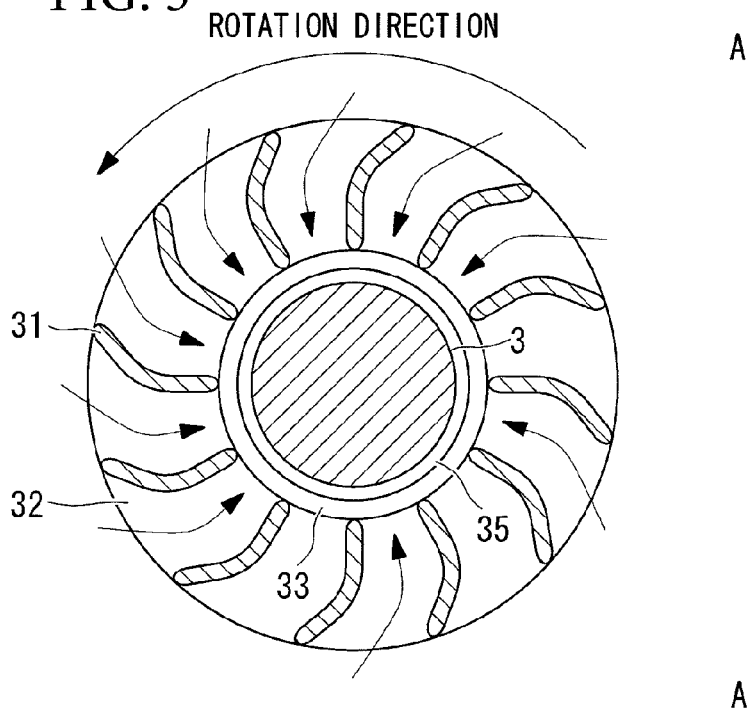
FIG. 3 is a cross-sectional view explaining the structure of guide plates shown in FIG. 2 along the line A-A.

FIG. 2 is a schematic view for explaining the structure of the sealing device shown in FIG. 1. FIG. 3 is a cross-sectional view for explaining the structure of the guide plates shown in FIG. 2 along the line A-A.

The plurality of guide plates 31 are blade-like members used to cancel circumferential flow-velocity components included in a leakage flow passing through the sealing device 5.

As shown in FIGS. 1 to 3, on a surface of the impeller chamber 13 that faces the disc 22 and that is adjacent to the rotary shaft 3, the guide plates 31 extend along the axial direction of the rotary shaft 3 and are disposed at equal intervals in the circumferential direction. Further, towards the outer side in the radial direction, the guide plates 31 are disposed at an angle in a direction opposite to the rotation direction of the rotary shaft 3.

The partition plate 32 is a ring-plate-like member serving as a partition between spaces between the plurality of guide plates 31 and a space between the disc 22 and the guide plates 31.

The partition plate 32 is the ring-plate-like member extending in the radial direction and is disposed to connect ends of the plurality of guide plates 31 that are close to the disc 22.

The first seal part 33 blocks a gas flow flowing between the disc 22 and the partition plate 32 and guides most of a gas flow flowing between the disc 22 and the impeller chamber 13 to the spaces surrounded by the plurality of guide plates 31, the partition plate 32, and the impeller chamber 13.

The first seal part 33 is an annular protrusion extending from an inner-circumferential end of the partition plate 32 toward the rotary shaft 3, in other words, extending inward in the radial direction, forming a first gap 35 with respect to the rotary shaft 3.

The second seal part 34 blocks a gas flow flowing between the housing 2 and the rotary shaft 3 to prevent high-pressure gas from leaking from the inside of the compressor 1 to the outside.

The second seal part 34 is a plurality of annular protrusions extending from a surface of the housing 2 that faces the rotary shaft 3 toward the rotary shaft 3, in other words, extending inward in the radial direction, to form a labyrinth seal. A second gap 36 is formed between the second seal part 34 and the rotary shaft 3.

Next, generation of high-pressure gas in the compressor 1, having the above-described structure, will be described with reference to FIG. 1.

When the compressor 1 is externally supplied with rotary driving force, the impeller 4 is rotationally driven via the rotary shaft 3. When the impeller 4 is rotationally driven, gas flowing between the rotary vanes 21 is rotated together with the rotary vanes 21 and is blown outward in the radial direction by centrifugal force. On the other hand, low-pressure gas flows in between the rotary vanes 21 from the low-pressure-side flow passage 12.

The gas blown outward in the radial direction flows into the high-pressure-side flow passage 11, which also serves as a diffuser, and changes to high-pressure gas after dynamic pressure given by the impeller 4 is converted into static pressure. The high-pressure gas generated in this way is supplied to the outside via the high-pressure-side flow passage 11.

On the other hand, part of the high-pressure gas in the high-pressure-side flow passage 11 flows in between the impeller chamber 13 and the shroud 23 or between the impeller chamber 13 and the disc 22.

The high-pressure gas flowing in between the impeller chamber 13 and the shroud 23 flows toward the low-pressure-side flow passage 12 because of the difference in pressure. This flow is blocked by the shroud-side seal part 24, and its flow rate is reduced.

Further, another part of the high-pressure gas in the high-pressure-side flow passage 11 flows in between the impeller chamber 13 and the disc 22 and then flows via the space between the rotary shaft 3 and the housing 2 toward the atmosphere, which has a lower pressure than the high-pressure gas (hereinafter, this flow is referred to as disc-back flow).

This flow is blocked by the sealing device 5 disposed between the rotary shaft 3 and the housing 2, and its flow rate is reduced. The flow of leaking gas in the sealing device 5 will be described in detail below.

Next, the operation of the sealing device 5, which is a feature of this embodiment, will be described with reference to FIGS. 2 and 3.

As described above, the disc-back flow flowing between the impeller chamber 13 and the disc 22 includes flow velocity components in the rotation direction of the rotary shaft 3, due to the rotation of the disc 22, and becomes a swirling flow or a rotating flow.

Most of the disc-back flow flows into the spaces surrounded by the guide plates 31, the housing 2, and the partition plate 32. As shown in FIGS. 2 and 3, since the guide plates 31 are inclined in the direction opposite to the rotation direction of the rotary shaft 3 (against the rotation direction) towards the outer side in the radial direction, angles of attack of the guide plates 31 with respect to the disc-back flow are reduced. Therefore, the disc-back flow flows along the guide plates 31, in other words, flows without being separated from the guide plates 31, to flow in between the guide plates 31.

Since the guide plates 31 extend along the radial direction in an area adjacent to outflow ends of the guide plates 31, the disc-back flow flowing out from between the guide plates 31 does not include flow velocity components in the rotation direction.

The first seal part 33 is disposed between the rotary shaft 3 and the partition plate 32, and a throttle is formed of the first gap 35 formed by the first seal part 33 and the rotary shaft 3. Therefore, since a flow passage formed between the disc 22 and the partition plate 32 has a higher passage resistance than passages formed between the guide plates 31, most of the disc-back flow flows into the passages formed between the guide plates 31.

Further, since the partition plate 32 is provided on the ends of the guide plates 31 that are close to the disc 22, the disc-back flow neither flows from between the guide plates 31 to between the disc 22 and the partition plate 32 nor flows in reverse from between the disc 22 and the partition plate 32 to between the guide plates 31.

On the other hand, the rest of the disc-back flow that has passed through the first gap 35 joins the disc-back flow that has passed between the guide plates 31 and flows along the outer circumferential surface of the rotary shaft 3 toward the second seal part 34.

In this embodiment, a description is given of an example case where the first gap 35 is sufficiently narrow, and a flow blocking function of the first seal part 33 sufficiently works.

As described above, the gas flow flowing along the outer circumferential surface of the rotary shaft 3 flows substantially along the axial direction of the rotary shaft 3 after most of the circumferential flow-velocity components are eliminated therefrom. This flow is blocked by the second seal part 34, which forms the labyrinth seal.

Part of the gas flow blocked by the second seal part 34 passes through the second gap 36 between the second seal part 34 and the rotary shaft 3 to flow out to the atmosphere.

According to the above-described structure, most of the disc-back flow flowing from the plurality of guide plates 31 toward the second seal part 34 flows between the plurality of guide plates 31 surrounded by the plurality of guide plates 31, the housing 2, and the partition plate 32, and the rest of the disc-back flow flows through the first gap 35 formed by the first seal part 33. Since the plurality of guide plates 31 extend along at least one of the radial direction and the axial direction of the rotary shaft 3, flow velocity components in the radial direction included in fluid flowing between the plurality of guide plates 31 are cancelled or eliminated while the disc-back flow flows between the plurality of guide plates 31. Therefore, it is possible to stabilize the behavior of the rotary shaft 3 in the compressor 1.

When the disc-back flow flowing through the spaces between the plurality of guide plates 31 is directed inward along the radial direction, the length of the sealing device 5 along the axial direction can be reduced.

Further, it is possible to increase the lengths of the guide plates 31 in the direction along the disc-back flow, that is, the lengths thereof in the radial direction, without changing the length of the sealing device 5 along the axial direction. Therefore, the flow velocity components in the radial direction included in the disc-back flow can be cancelled or eliminated more reliably while the fluid flows between the plurality of guide plates 31.

The guide plates 31 are formed in a blade-like shape and are curved against the rotation direction of the rotary shaft 3, thereby making it possible to reduce loss that occurs when the flow velocity components in the circumferential direction included in the disc-back flow are cancelled or eliminated, compared with plate-like guide plates.

Figure 4:
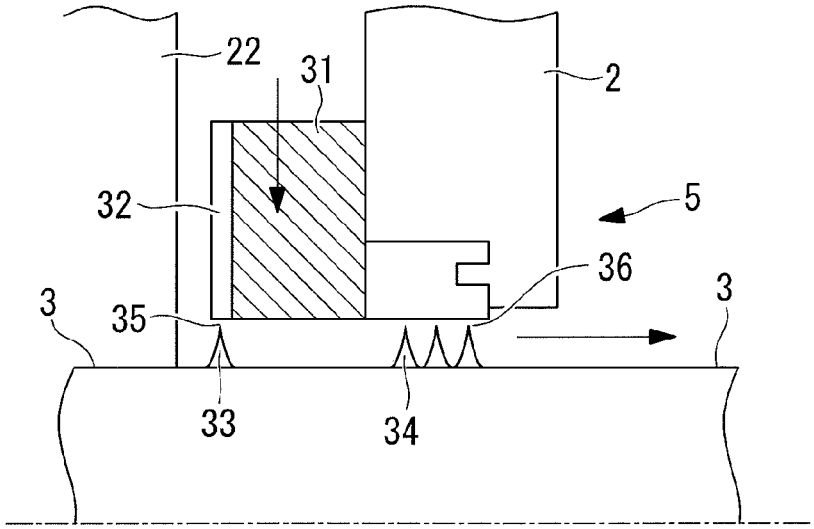
FIG. 4 is a schematic view explaining the sealing device shown in FIG. 2 according to another embodiment.

FIG. 4 is a schematic view for explaining the sealing device shown in FIG. 2 according to another embodiment.

Note that, as in the above-described embodiment, the first seal part 33 and the second seal part 34 may be annular protrusions extending inward in the radial direction to respectively form the first gap 35 and the second gap 36 with respect to the rotary shaft 3, or, as shown in FIG. 4, the first seal part 33 and the second seal part 34 may be annular protrusions extending outward in the radial direction to form the first gap 35 between the first seal part 33 and the partition plate 32 and to form the second gap 36 between the second seal part 34 and the housing 2; their structures are not particularly limited.

First Modification of First Embodiment

Next, a first modification of the first embodiment of the present invention will be described with reference to FIGS. 5 and 6.

Although the basic structure of a compressor of this modification is the same as that of the first embodiment, the structure of a sealing device is different from that of the first embodiment. Therefore, in this modification, only the structure of the sealing device and components surrounding it will be described with reference to FIGS. 5 and 6, and a description of the other components will be omitted.

Figure 5:
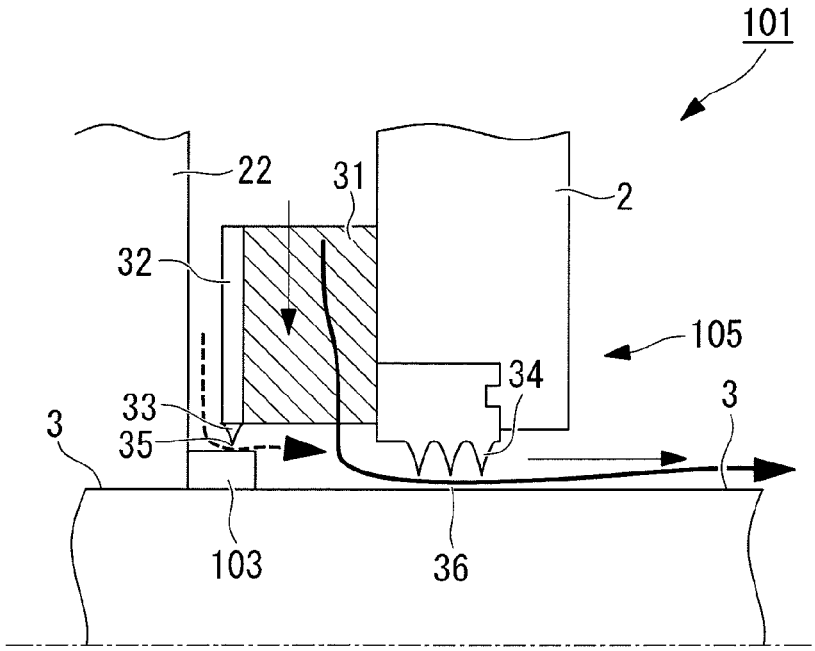
FIG. 5 is a schematic view explaining the structure of a sealing device in a compressor according to a first modification of the first embodiment of the present invention.

FIG. 5 is a schematic view for explaining the structure of the sealing device in the compressor according to this modification.

Note that identical reference numerals are given to the same components as those of the first embodiment, and a description thereof will be omitted.

As shown in FIG. 5, a sealing device 105 of a compressor (rotary fluid machine) 101 includes the plurality of guide plates 31, the partition plate 32, the first seal part 33, the second seal part 34, and a step part 103.

The step part 103 is a cylindrical member disposed on the outer circumferential surface of the rotary shaft 3, and is disposed adjacent to the disc 22 of the impeller 4.

The length of the step part 103 in the axial direction of the rotary shaft 3 is larger than the length of at least a gap between the disc 22 and the partition plate 32, and the thickness of the step part 103, in other words, the thickness from the inner circumferential surface to the outer circumferential surface of the step part 103, is larger than the length of the second gap 36.

Therefore, the first gap 35 is formed between the step part 103 and the first seal part 33. The first gap 35 formed in this modification is equal to or wider than the first gap 35 of the first embodiment. Further, the distance of the first gap 35 from the rotary shaft 3, that is, the position of the first gap 35 in the radial direction, is farther than that of the second gap 36 from the rotary shaft 3. In other words, the first gap 35 is located farther radially outward than the second gap 36.

Next, the operation of the sealing device 105, which is a feature of this modification, will be described with reference to FIG. 5. Note that since high-pressure gas is generated in the compressor 101 of this modification in the same way as in the first embodiment, a description thereof will be omitted.

Since the disc-back flow flows between the guide plates 31 in the same way as in the first embodiment, a description thereof will be omitted.

The disc-back flow that has passed through the first gap 35 formed between the first seal part 33 and the step part 103 flows along the axial direction of the rotary shaft 3 and is blocked when colliding against the annular protrusions of the second seal part 34 or the housing 2.

Since the subsequent flow of the gas is the same as that in the first embodiment, a description thereof will be omitted.

According to the above-described structure, the step part 103, which radially expands the outer circumferential surface of the rotary shaft 3, is provided at a location facing the first seal part 33, thereby changing the relative position of the first gap 35 and the second gap 36 in the radial direction. Therefore, the disc-back flow that has passed through the first gap 35 is prevented from directly flowing into the second gap 36, and the sealing performance of the sealing device 105 can be improved.

Figure 6:
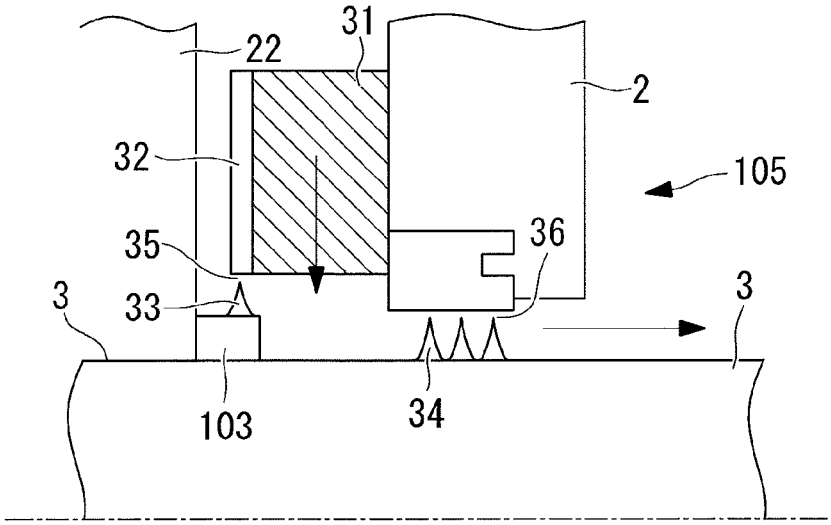
FIG. 6 is a schematic view explaining the sealing device shown in FIG. 5 according to another embodiment.

FIG. 6 is a schematic view for explaining the sealing device shown in FIG. 5 according to another embodiment.

Note that, as in the above-described modification, the first seal part 33 and the second seal part 34 may be annular protrusions extending inward in the radial direction to form the first gap 35 with respect to the step part 103 and to form the second gap 36 with respect to the rotary shaft 3, or, as shown in FIG. 6, the first seal part 33 and the second seal part 34 may be annular protrusions extending outward in the radial direction to form the first gap 35 between the first seal part 33 and the partition plate 32 and to form the second gap 36 between the second seal part 34 and the housing 2; their structures are not particularly limited.

Second Modification of First Embodiment

Next, a second modification of the first embodiment of the present invention will be described with reference to FIG. 7.

Although the basic structure of a compressor of this modification is the same as that of the first embodiment, the structure of a sealing device is different from that of the first embodiment. Therefore, in this modification, only the structure of the sealing device and components surrounding it will be described with reference to FIG. 7, and a description of the other components will be omitted.

Figure 7:
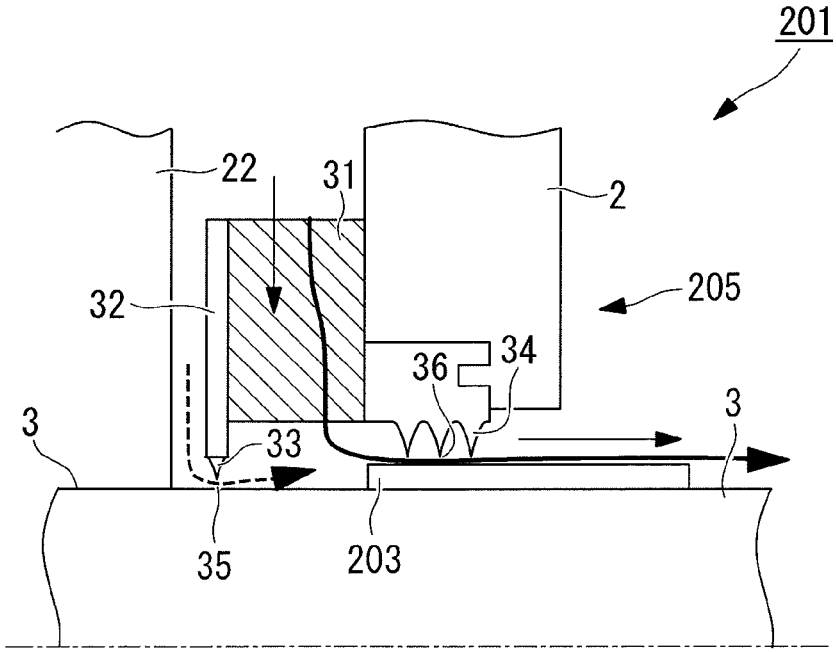
FIG. 7 is a schematic view explaining the structure of a sealing device in a compressor according to a second modification of the first embodiment of the present invention.

FIG. 7 is a schematic view for explaining the structure of the sealing device in the compressor according to this modification.

Note that identical reference numerals are given to the same components as those of the first embodiment, and a description thereof will be omitted.

As shown in FIG. 7, a sealing device 205 of a compressor (rotary fluid machine) 201 includes the plurality of guide plates 31, the partition plate 32, the first seal part 33, the second seal part 34, and a step part (step part) 203.

The step part 203 is a cylindrical member disposed on the outer circumferential surface of the rotary shaft 3 and is disposed at a location facing the second seal part 34.

The thickness of the step part 203, in other words, the thickness from the inner circumferential surface to the outer circumferential surface of the step part 203, is larger than the length of the first gap 35, and, more preferably, is larger than the thickness of the boundary layer of the gas flow flowing out from the first gap 35. Further, the distance of the second gap 36 from the rotary shaft 3, that is, the position of the second gap 36 in the radial direction, is farther than that of the first gap 35 from the rotary shaft 3. In other words, the second gap 36 is located farther radially outward than the first gap 35.

Next, the operation of the sealing device 205, which is a feature of this modification, will be described with reference to FIG. 7. Note that since high-pressure gas is generated in the compressor 201 of this modification in the same way as in the first embodiment, a description thereof will be omitted.

Since the disc-back flow flows between the guide plates 31 in the same way as in the first embodiment, a description thereof will be omitted.

The disc-back flow that has passed through the first gap 35 formed between the first seal part 33 and the rotary shaft 3 flows along the outer circumferential surface of the rotary shaft 3 and collides against an end face of the step part 203, in other words, a step face formed by providing the step part 203 on the rotary shaft 3.

Since the subsequent flow of the gas is the same as that in the first embodiment, a description thereof will be omitted.

According to the above-described structure, the step part 203, which radially expands the outer circumferential surface of the rotary shaft 3, is provided at a location facing the second seal part 34, thereby changing the relative position of the first gap 35 and the second gap 36 in the radial direction. Therefore, the disc-back flow that has passed through the first gap 35 is prevented from directly flowing into the second gap 36, and the sealing performance of the sealing device 205 can be improved.

Second Embodiment

Next, a second embodiment of the present invention will be described with reference to FIGS. 8 to 10.

Although the basic structure of a compressor of this embodiment is the same as that of the first embodiment, the structure of a sealing device is different from that of the first embodiment. Therefore, in this embodiment, only the structure of the sealing device and components surrounding it will be described with reference to FIGS. 8 to 10, and a description of the other components will be omitted.

Figure 8:
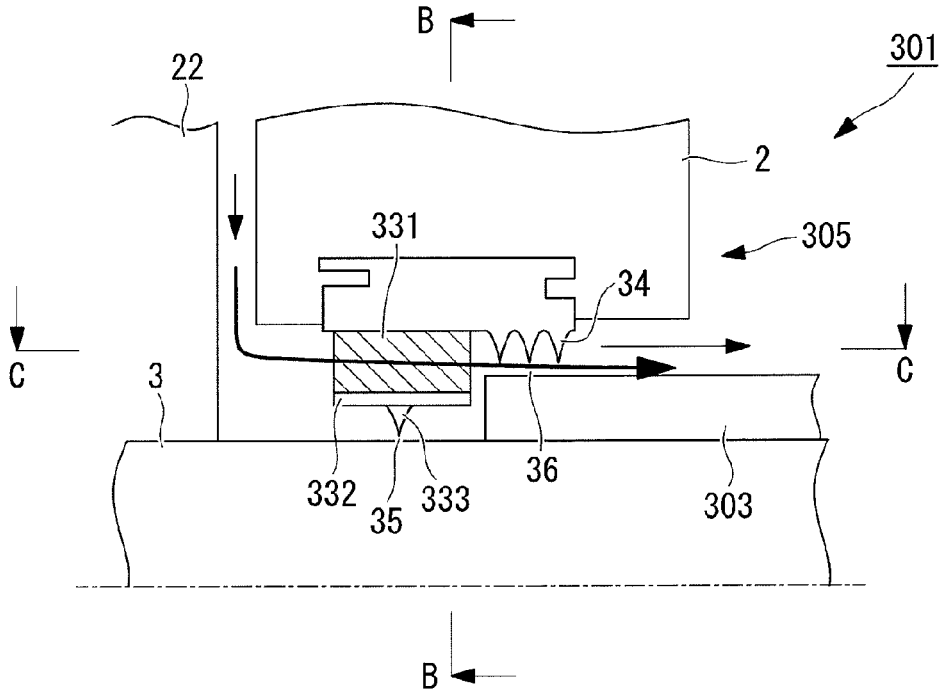
FIG. 8 is a schematic view explaining the structure of a sealing device in a compressor according to a second embodiment of the present invention.

FIG. 8 is a schematic view for explaining the structure of the sealing device in the compressor according to this embodiment.

Note that identical reference numerals are given to the same components as those of the first embodiment, and a description thereof will be omitted.

As shown in FIG. 8, a sealing device 305 of a compressor (rotary fluid machine) 301 includes a plurality of guide plates (guide parts) 331, a partition plate (partition part) 332, a first seal part 333, the second seal part 34, and a step part 303.

Figure 9:
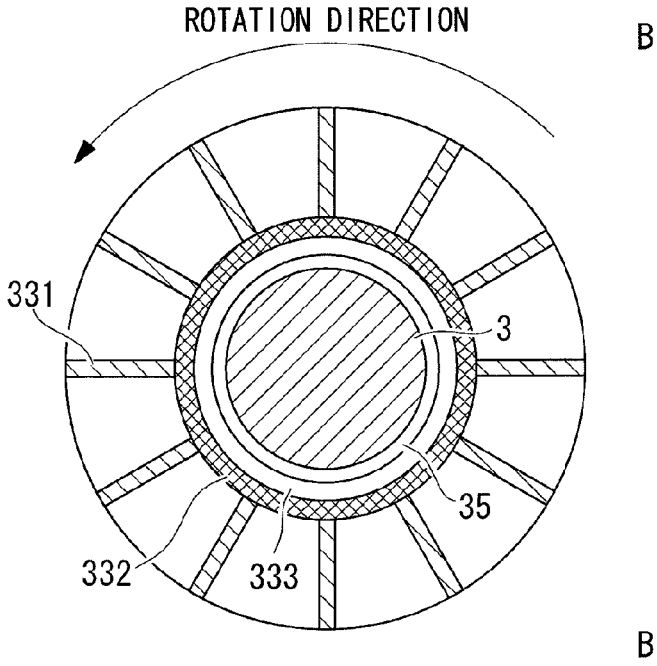
FIG. 9 is a cross-sectional view explaining the structure of guide plates shown in FIG. 8 along the line B-B.

FIG. 9 is a cross-sectional view for explaining the structure of the guide plates shown in FIG. 8 along the line B-B. FIG. 10 is a cross-sectional view for explaining the structure of the guide plates shown in FIG. 8 along the line C-C.

The plurality of guide plates 331 are plate-like members used to cancel flow velocity components in the circumferential direction included in a leakage flow passing through the sealing device 305.

Figure 10:
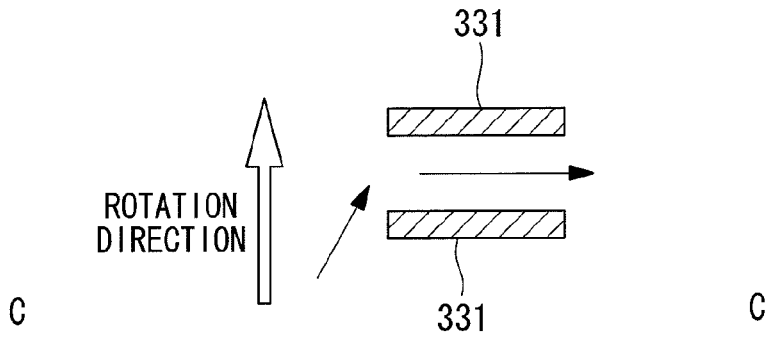
FIG. 10 is a cross-sectional view explaining the structure of the guide plates shown in FIG. 8 along the line C-C.

As shown in FIGS. 8 to 10, on a surface of the housing 2 that faces the rotary shaft 3, the guide plates 331 extend along the axial direction and the radial direction of the rotary shaft 3 and are disposed at equal intervals in the circumferential direction.

The partition plate 332 is a cylindrical member serving as a partition between spaces between the plurality of guide plates 331 and a space between the rotary shaft 3 and the guide plates 331.

The partition plate 332 is a cylindrical member extending in the axial direction of the rotary shaft 3 and is disposed to connect ends of the plurality of guide plates 331 that are close to the rotary shaft 3.

The first seal part 333 blocks the gas flow flowing between the rotary shaft 3 and the partition plate 332 and guides most of the gas flow flowing between the rotary shaft 3 and the housing 2 to the spaces surrounded by the plurality of guide plates 331, the partition plate 332, and the housing 2.

The first seal part 333 is an annular protrusion extending from the center portion on the inner circumferential surface of the partition plate 332 toward the rotary shaft 3, in other words, extending inward in the radial direction, forming the first gap 35 with respect to the rotary shaft 3.

The step part 303 is a cylindrical member disposed on the outer circumferential surface of the rotary shaft 3 and is disposed at a location facing the second seal part 34.

In the step part 303, the thickness of the step part 303, that is, the thickness from the inner circumferential surface to the outer circumferential surface of the step part 303, is larger than the first gap 35, in other words, it is larger than the thickness of the boundary layer of the gas flow flowing out from the first gap 35. More preferably, it is formed with a thickness from the outer circumferential surface of the rotary shaft 3 up to approximately the center positions of the guide plates 331 in the radial direction. Further, the distance of the second gap 36 from the rotary shaft 3, that is, the position of the second gap 36 in the radial direction, is farther than that of the first gap 35 from the rotary shaft 3. In other words, the second gap 36 is located farther radially outward than the first gap 35.

Next, the operation of the sealing device 305, which is a feature of this embodiment, will be described with reference to FIGS. 8 to 10. Note that since high-pressure gas is generated in the compressor 301 of this embodiment in the same way as in the first embodiment, a description thereof will be omitted.

As shown in FIG. 8, the disc-back flow flows from between the disc 22 and the impeller chamber 13 into the space between the rotary shaft 3 and the housing 2, and flows along the axial direction of the rotary shaft 3. Most of the gas flow flowing along the rotary shaft 3 flows into the spaces surrounded by the guide plates 331, the housing 2, and the partition plate 332. As shown in FIG. 9 or 10, since the guide plates 331 extend along the radial direction and the axial direction of the rotary shaft 3, the disc-back flow flowing out from between the guide plates 331 does not include flow velocity components in the rotation direction.

The first seal part 333 is disposed between the rotary shaft 3 and the partition plate 332, and a throttle is formed of the first gap 35 formed by the first seal part 333 and the rotary shaft 3. Therefore, since a passage formed between the rotary shaft 3 and the partition plate 32 has a higher flow passage resistance than passages formed between the guide plates 331, most of the gas flow flows into the passages formed between the guide plates 331.

Flow velocity components in the circumferential direction included in the gas flow are cancelled or eliminated while the gas flow flows through the passages formed between the guide plates 331.

Further, since the partition plate 332 is provided at the ends of the guide plates 331 close to the rotary shaft 3, a gas flow neither flows from between the guide plates 331 to between the rotary shaft 3 and the partition plate 332 nor flows in reverse from between the rotary shaft 3 and the partition plate 332 to between the guide plates 331.

On the other hand, the rest of the gas flow that has passed through the first gap 35 flows along the outer circumferential surface of the rotary shaft 3 toward the second seal part 34 and is blocked by an end face of the step part 303, in other words, by a step face formed by providing the step part 303 on the rotary shaft 3.

The gas flow that has flowed out from between the guide plates 331 flows between the outer circumferential surface of the step part 303 and the housing 2 along the axial direction of the rotary shaft 3, and is blocked by the second seal part 34. Part of the gas flow blocked by the second seal part 34 passes through the second gap 36 between the second seal part 34 and the step part 303 to flow out to the atmosphere.

According to the above-described structure, gas flowing through the spaces between the plurality of guide plates 331 is directed toward the second seal part 34 along the axial direction, thereby making it possible to reduce the length of the sealing device 305 along the radial direction.

The step part 303, which radially expands the outer circumferential surface of the rotary shaft 3, is provided at a location facing the second seal part 34, thereby changing the relative position of the first gap 35 and the second gap 36 in the radial direction. Therefore, gas that has passed through the first gap 35 is prevented from directly flowing into the second gap 36, and the sealing performance of the sealing device 305 can be improved.

The guide plates 331 are formed in a plate-like shape, which is simpler than the shape of blade-like guide plates, for example, and therefore the sealing device 305 is easily manufactured.

First Modification of Second Embodiment

Next, a first modification of the second embodiment of the present invention will be described with reference to FIGS. 11 to 13.

Although the basic structure of a compressor of this modification is the same as that of the second embodiment, the structure of a sealing device is different from that of the second embodiment. Therefore, in this modification, only the structure of the sealing device and components surrounding it will be described with reference to FIGS. 11 to 13, and a description of the other components will be omitted.

Figure 11:
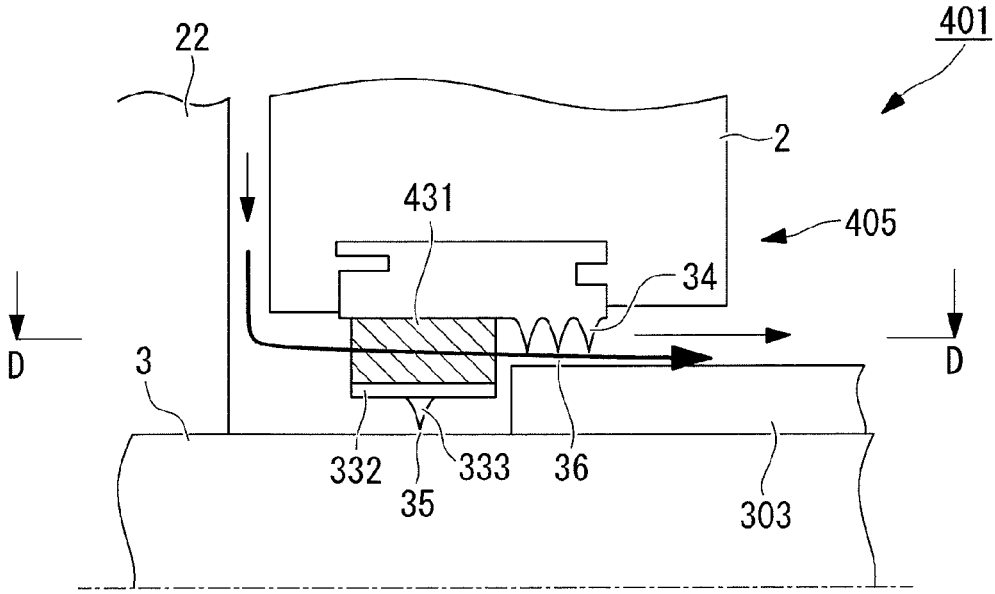
FIG. 11 is a schematic view explaining the structure of a sealing device in a compressor according to a first modification of the second embodiment of the present invention.

FIG. 11 is a schematic view for explaining the structure of the sealing device in the compressor according to this modification. FIG. 12 is a cross-sectional view for explaining the structure of the sealing device shown in FIG. 11 along the line D-D.

Note that identical reference numerals are given to the same components as those of the second embodiment, and a description thereof will be omitted.

As shown in FIG. 11, a sealing device 405 of a compressor (rotary fluid machine) 401 includes a plurality of guide plates (guide parts) 431, the partition plate 332, the first seal part 333, the second seal part 34, and the step part 303.

The plurality of guide plates 431 are blade-like members used to cancel flow velocity components in the circumferential direction included in a leakage flow passing through the sealing device 405.

Figure 12:
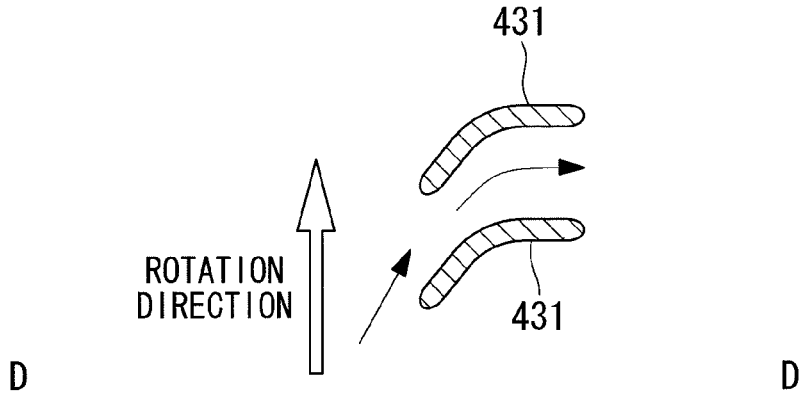
FIG. 12 is a cross-sectional view explaining the structure of the sealing device shown in FIG. 11 along the line D-D.

As shown in FIGS. 11 and 12, on a surface of the housing 2 facing the rotary shaft 3, the guide plates 431 extend along the radial direction of the rotary shaft 3 and are disposed at equal intervals in the circumferential direction. Further, the guide plates 431 are disposed so as to be curved in a direction opposite to the rotation direction of the rotary shaft 3, toward the disc 22 in the axial direction.

Next, the operation of the sealing device 405, which is a feature of this modification, will be described with reference to FIGS. 11 and 12. Note that since high-pressure gas is generated in the compressor 401 of this modification in the same way as in the first embodiment, a description thereof will be omitted.

As shown in FIG. 11, the disc-back flow flows from between the disc 22 and the impeller chamber 13 into the space between the rotary shaft 3 and the housing 2 and flows along the axial direction of the rotary shaft 3. Most of the gas flow flowing along the rotary shaft 3 flows into the spaces surrounded by the guide plates 431, the housing 2, and the partition plate 332.

As shown in FIGS. 11 and 12, since the guide plates 431 are curved in a direction opposite to the rotation direction of the rotary shaft 3 (against the rotation direction), toward the disc 22 in the axial direction, angles of attack of the guide plates 431 with respect to the gas flow are reduced. Therefore, the gas flow flows along the guide plates 431, in other words, flows without being separated from the guide plates 431, to flow into the spaces between the guide plates 431.

Since the guide plates 431 extend along the axial direction in an area adjacent to outflow ends of the guide plates 431, the gas flow flowing out from between the guide plates 431 does not include flow velocity components in the rotation direction.

Since the subsequent gas flow is the same as that in the second embodiment, a description thereof will be omitted.

According to the above-described structure, the guide plates 431 are formed in a blade-like shape and are curved against the rotation direction of the rotary shaft 3, thereby making it possible to reduce loss that occurs when the flow velocity components in the circumferential direction included in the gas flow are cancelled or eliminated, compared with plate-like guide plates.

Figure 13:
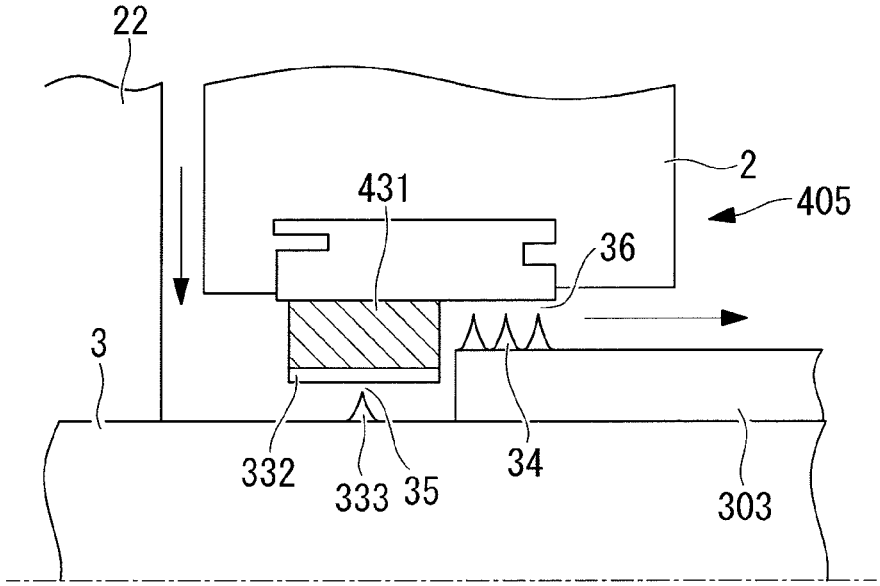
FIG. 13 is a schematic view explaining the sealing device shown in FIG. 11 according to another embodiment.

FIG. 13 is a schematic view for explaining the sealing device shown in FIG. 11 according to another embodiment.

Note that, as in the above-described embodiment, the first seal part 333 and the second seal part 34 may be annular protrusions extending inward in the radial direction to form the first gap 35 with respect to the rotary shaft 3 and to form the second gap 36 with respect to the step part 303, or, as shown in FIG. 13, the first seal part 333 and the second seal part 34 may be annular protrusions extending outward in the radial direction to form the first gap 35 between the first seal part 333 and the partition plate 32 and to form the second gap 36 between the second seal part 34 and the housing 2; their structures are not particularly limited.

Second Modification of Second Embodiment

Next, a second modification of the second embodiment of the present invention will be described with reference to FIGS. 14 and 15.

Although the basic structure of a compressor of this modification is the same as that of the second embodiment, the structure of a sealing device is different from that of the second embodiment. Therefore, in this modification, only the structure of the sealing device and components surrounding it will be described with reference to FIGS. 14 and 15, and a description of the other components will be omitted.

Figure 14:
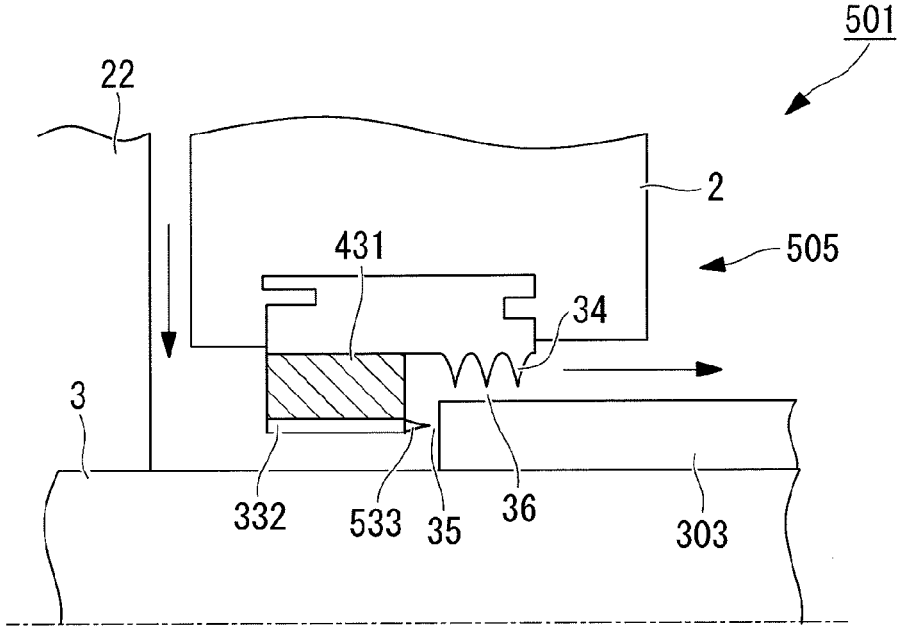
FIG. 14 is a schematic view explaining the structure of a sealing device in a compressor according to a second modification of the second embodiment of the present invention.

FIG. 14 is a schematic view for explaining the structure of the sealing device in the compressor according to this modification.

Note that identical reference numerals are given to the same components as those of the second embodiment, and a description thereof will be omitted.

As shown in FIG. 14, a sealing device 505 of a compressor (rotary fluid machine) 501 includes the plurality of guide plates 431, the partition plate 332, a first seal part 533, the second seal part 34, and the step part 303.

The first seal part 533 blocks a gas flow flowing between the rotary shaft 3 and the partition plate 32 and guides most of a gas flow flowing between the rotary shaft 3 and the housing 2 to the spaces surrounded by the plurality of guide plates 431, the partition plate 332, and the housing 2.

As shown in FIG. 14, the first seal part 533 is an annular protrusion extending along the axis of the rotary shaft 3 toward the step face of the step part 303, forming the first gap 35 with respect to the step part 303.

Next, the operation of the sealing device 505, which is a feature of this modification, will be described with reference to FIG. 14. Note that since high-pressure gas is generated in the compressor 501 of this modification in the same way as in the first embodiment, a description thereof will be omitted.

As shown in FIG. 14, the disc-back flow flows from between the disc 22 and the impeller chamber 13 into the space between the rotary shaft 3 and the housing 2 and flows along the axial direction of the rotary shaft 3. Most of the gas flow flowing along the rotary shaft 3 flows into the spaces surrounded by the guide plates 431, the housing 2, and the partition plate 332.

The first seal part 533 is disposed between the rotary shaft 3 and the partition plate 332 at a downstream side, and a throttle is formed of the first gap 35 formed by the first seal part 533 and the step part 303. Therefore, since a flow passage formed between the rotary shaft 3 and the partition plate 332 has a higher passage resistance than passages formed between the guide plates 431, most of the gas flow flows into the passages formed between the guide plates 431.

Since the subsequent gas flow is the same as that in the second embodiment, a description thereof will be omitted.

According to the above-described structure, the first seal part 533 is an annular protrusion extending along the axis of the rotary shaft 3 toward the step face of the step part 303. Therefore, gas that has passed thought the first gap 35 is prevented from directly flowing into the second gap 36, and the sealing performance of the sealing device 505 can be improved.

Figure 15:
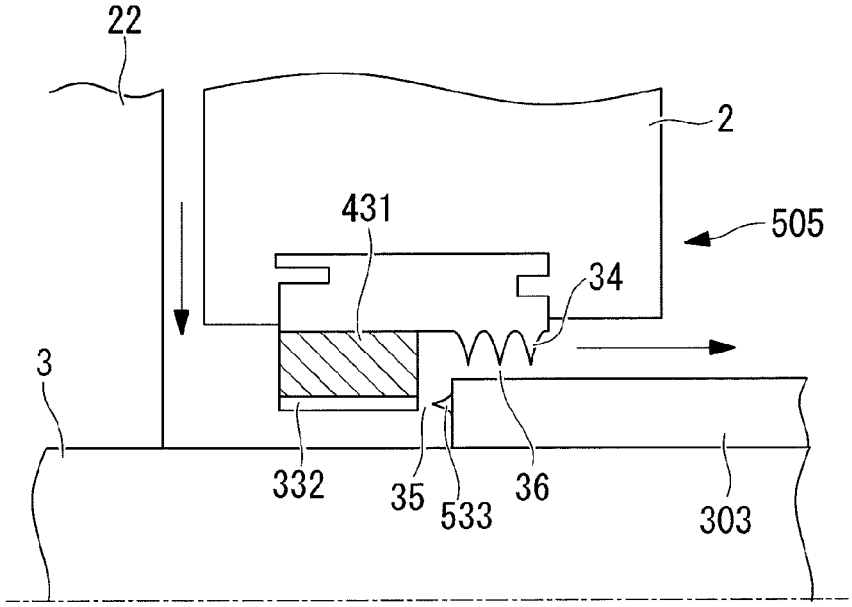
FIG. 15 is a schematic view explaining the sealing device shown in FIG. 14 according to another embodiment.

FIG. 15 is a schematic view for explaining the sealing device shown in FIG. 14 according to another embodiment.

Note that, as in the above-described modification, the first seal part 533 may be an annular protrusion extending along the axial direction toward the step face of the step part 303, or, as shown in FIG. 15, the first seal part 533 may be an annular protrusion extending along the axial direction toward the partition plate 332 to form the first gap 35 between the first seal part 533 and the partition plate 332; the structure thereof is not particularly limited.

Note that the technical scope of the present invention is not limited to the above-described embodiments, and various modifications can be made without departing from the gist of the present invention.

In the above-described embodiments, the invention is applied to a single-stage compressor. The invention is not limited to application to compressors and can be applied to, for example, other rotary fluid machines such as expanders.

Expanders are used for a surplus of high-pressure gas to be supplied to another apparatus in a factory, for example.

Expanders convert energy of such high-pressure gas into rotational energy to be used to assist the rotational driving of a motor or the like.

In the above-described embodiments, the present invention is applied to a centrifugal compressor. The present invention is not limited to application to a centrifugal compressor and may be applied to a mixed flow compressor; machines to which the present invention is applied are not particularly limited.

The invention claimed is:

1. A sealing device for a rotary fluid machine, comprising:

a housing having an inner surface, and being configured to rotatably accommodate a rotary shaft;

a plurality of guide parts mounted on said inner surface of said housing, said plurality of guide parts extending along at least one of a radial direction and an axial direction of the rotary shaft, and being arranged side-by-side in a circumferential direction of the rotary shaft, said plurality of guide parts having first ends and second ends, said second ends being opposite said first ends;

a partition part connecting said first ends of said plurality of guide parts, said second ends of said plurality of guide parts being mounted on said housing, and said partition plate being a partition between spaces between said plurality of guide parts and an outside space;

a first seal part that is an annular protrusion, and being configured to form a first gap with respect to the rotary shaft or said partition part, and being configured to block a flow of fluid passing through the outside space; and a second seal part that is an annular protrusion extending in the radial direction, and being configured to form a second gap with respect to the rotary shaft or said housing, and being configured to block a flow of fluid that has passed through the spaces between said plurality of guide parts and a flow of fluid that has passed through said first seal part, wherein said sealing device is configured to permit the fluid to pass inward in the radial direction through the spaces between said plurality of guide parts.

2. A sealing device for a rotary fluid machine, according to claim 1, wherein:

said first ends of said plurality of guide parts are configured and arranged so as to face an impeller extending from the rotary shaft outward in the radial direction; and said partition part extends in the radial direction and is formed in a ring-plate shape to connect said first ends.

3. A sealing device for a rotary fluid machine, according to claim 2, wherein:

said first seal part extends in the radial direction; and said first seal part or said second seal part is configured and arranged so as to face a step part radially extending the outer circumferential surface of the rotary shaft.

4. A sealing device for a rotary fluid machine, according to claim 1, wherein:

said first ends of said plurality of guide parts are configured and arranged to face an outer circumferential surface of the rotary shaft; and said partition part extends in the axial direction, is formed in a cylindrical shape to connect said first ends, and is configured to permit the fluid to pass along the axial direction through the spaces between said plurality of guide parts.

5. A sealing device for a rotary fluid machine, according to claim 4, wherein:

said first seal part extends in the radial direction; and said first seal part or said second seal part is configured and arranged to face a step part radially extending the outer circumferential surface of the rotary shaft.

6. A sealing device for a rotary fluid machine, according to claim 1, wherein said plurality of guide parts are plate members extending along the radial direction or the axial direction.

7. A sealing device for a rotary fluid machine, according to claim 1, wherein said plurality of guide parts are blade members extending along the radial direction or the axial direction and are curved against a rotation direction of the rotary shaft.

8. A rotary fluid machine comprising a sealing device according to one claim 1.

* * * * *